United States Patent [19]

Rolirad

[11] Patent Number: 4,754,918

[45] Date of Patent: Jul. 5, 1988

[54] SIGNAL FLAG FOR USE ON RURAL MAIL BOXES

[76] Inventor: Larry S. Rolirad, 1302 Dorsetshire, Pasadena, Tex. 77504

[21] Appl. No.: 945,088

[22] Filed: Dec. 22, 1986

[51] Int. Cl.[4] ..... A47G 29/12

[52] U.S. Cl. ..... 232/35; 232/34

[58] Field of Search ..... 232/35, 34, 37

[56] References Cited

U.S. PATENT DOCUMENTS

| | | | |
|---|---|---|---|
| 731,372 | 6/1903 | Jones | 232/35 X |
| 932,287 | 8/1909 | Jones | 232/35 |
| 1,627,617 | 5/1927 | Nordin . | |
| 1,949,578 | 3/1934 | Ott | 232/35 |
| 2,687,846 | 8/1954 | Chrisman | 232/35 |
| 2,730,298 | 1/1956 | Haserodt | 232/35 |
| 3,143,287 | 8/1964 | Holt | 232/35 |
| 3,176,918 | 4/1965 | Posch | 232/35 |
| 3,338,511 | 8/1967 | Cvar | 232/35 |
| 3,602,424 | 8/1971 | Paulson | 232/35 |
| 3,747,839 | 7/1973 | Morton | 232/35 |
| 4,158,430 | 6/1979 | Wideman | 232/35 |
| 4,190,193 | 2/1980 | Smith | 232/35 |
| 4,412,646 | 11/1983 | Hollenbach | 232/35 X |

*Primary Examiner*—Robert W. Gibson, Jr.

[57] ABSTRACT

A Signal Flag for use on Rural Mail Boxes having means for securing said flag to a panel, and securing said panel to the mail box adjacent the bottom of the door of the box, the means for mounting the flag to the panel being a pivot pin, and the signal flag being of a novel coutour, and conformed to present an imbalance at said pivot point, and to present a tab adapted to contact the door of the box, when in one position, and to move by gravity to an extended position, there being another tab on the other end of the flag to contact the bottom of the box when in extended position.

8 Claims, 1 Drawing Sheet

SIGNAL FLAG FOR USE ON RURAL MAIL BOXES

SUMMARY OF THE INVENTION

A signal flag to be mounted on the common rural mail boxes, said boxes having a hinged door at one end. The flag is pivoted on a bearing plate which is secured to the mail box by means of a pressure sensitive adhesive. The conformation of the flag is such that it will be contacted by mail box door when the box is opened, and will rotate forwardly with the door until the enlarged portion of the flag completes the rotation of the flag to the position indicated in FIG. 2 denoting the mail has been delivered. The signal will remain in this position after the door of the mail box is closed and until manually reset indicating that mail has been picked up.

BACKGROUND OF THE INVENTION

Outdoor mail boxes in rural areas are often subjected to much abuse, exposed to weather, mauled and distorted. Such abuse often destroys the signal flag now in use on the box. This invention intends to provide a signal flag that may be readily attached to any existing rural mail box, and requires no drilling of holes or mounting of brackets, the mounting plate employed, being simple to handle and requiring no express expertise in joining same to the outside wall of the mail box.

A preliminary search was made of the patent records and the only reference believed pertinent was Jones, 932,287 issued Aug. 24, 1909, which discloses a pivotal flag, actuated by the door of the box and a depressed portion of the flag will contact the box, and having wings which also contact the box. This is, of course, easily broken or mutilated by abuse and readily rendered inoperative. It is an object of this invention to provide a signal for rural mail boxes that is easily mounted on a box and that will remain operable even after rough usage.

A BRIEF DESCRIPTION OF THE PREFERRED EMBODIMENTS

Figure 1:
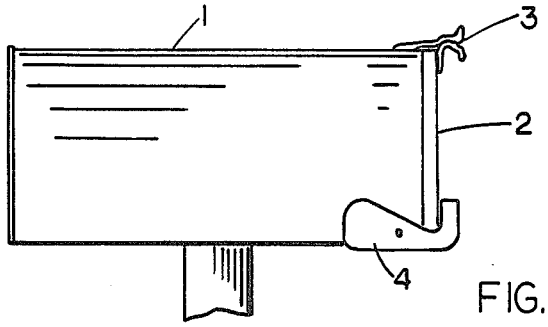
FIG. 1 is a side elevational, showing the mail box door closed.

In the drawings, the numeral 1 designates a mail box, of the type now in common use, having the usual hinged door 2 and latch 3. A signal flag, which may be painted a bright red on the outer surface, has a novel conformation wherein the longitudinal body is enlarged at one end, and the other end is reduced and curved at a right angle, and then sharply bent again at a right angle to form a tab 5. A mounting 6 consisting of a flat strip of rigid material, such as a hardened plastic, has a pin 7 mounted through the center thereof and through the body member of the flag 4 at a point approximately midway between the longitudinal ends of said flag and a pressure sensitive adhesive 8 is mounted on the inside surface of said mounted plate.

Figure 2:
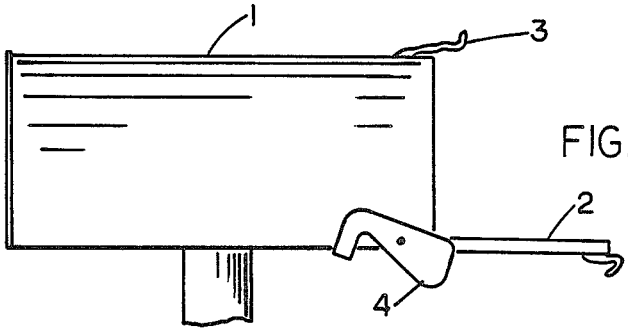
FIG. 2 is a side elevational view showing the mail box door open.
Figure 3:
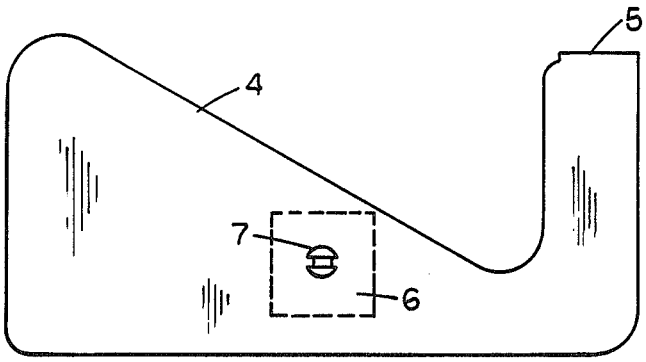
FIG. 3 is an enlarged view of the signal flag employed.
Figure 4:
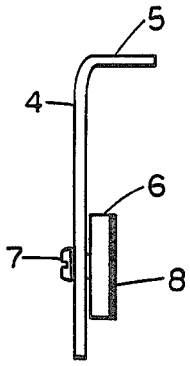
FIG. 4 is an end elevational view of the flag, showing the signal mounting plate and pivotal pin.
Figure 5:
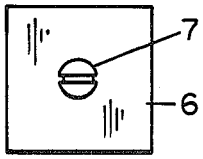
FIG. 5 is a side elevational view of the mounting plate.

In use the mounting plate is secured to the box adjacent the bottom of the door 2 with the tab 4 extending across the outside surface of the door when the door is in closed position. When the door is opened, as to receive mail, the door will drop to the position shown in FIG. 2, and the enlarged end of the flag will carry it around until the tab 5 abuts the bottom of the mail box, where the flag will extend beyond the door of the mail box and indicate to those at a distance from the box that mail has been delivered. When the mail is picked up, and the mail box door again closed, the user may manually rotate the flag backwardly until the tab 5 again contacts the door 2 where it will remain until the box is again opened.

What I claim is:

1. A signal flag for mounting on a mail box having a hinged door, top and bottom, said signal flag comprising a longitudinal body member rotatably secured to a mounting plate for mounting said longitudinal member to said mail box, wherein said longitudinal body member comprises:

a first enlarged end;

a second reduced end curved at a right angle from said first enlarged end; and a tab inwardly bent at a right angle from said second reduced end, wherein when said longitudinal body member is mounted to said mail box said tab will extend across said hinged door of said mail box when said hinged door is in a closed position and, wherein when said hinged door has been opened to cause said longitudinal body member to rotate, said tab will abut said bottom of said mail box.

2. The signal flag of claim 1, wherein said mounting plate comprises an adhesive to secure said mounting plate to said mail box.

3. The signal flag of claim 1, wherein said mounting plate comprises a pin mounted thereon and extending through said longitudinal body member, whereby said longitudinal body member pivots on said pin.

4. The signal flag of claim 3, wherein said pin extends through said longitudinal body member at a point approximately midway between said first enlarged end and second reduced end.

5. the signal flag of claim 1, wherein said tab extends across said hinged door of said mail box when said hinged door is initially in a closed position, and by gravity moves to abut said bottom of said mail box after said hinged door has been opened.

6. In the combination of a mail box comprising a hinged door, top and bottom, and a signal flag mounted to said mail box, said signal flag comprising a longitudinal body member rotatably secured to a mounting plate for mounting said longitudinal member to said mail box, wherein said longitudinal body member comprises:

a first enlarged end;

a second reduced end curved at an angle from said first enlarged end; and a tab inwardly bent from said second reduced end, wherein when said longitudinal body member is mounted to said mail box said tab will extend across said hinged door of said mail box when said hinged door is in a closed position and, wherein when said hinged door has been opened to cause said longitudinal body member to rotate, said tab will abut said bottom of said mail box.

7. The combination of claim 6, wherein said tab by gravity moves to abut said bottom of said mail box after said hinged door has been opened.

8. The combination of claim 6, wherein said mounting plate is mounted to said mail box adjacent a bottom of said hinged door.

* * * * *